United States Patent [19]

Quate et al.

[11] Patent Number: 5,041,849

[45] Date of Patent: Aug. 20, 1991

[54] MULTI-DISCRETE-PHASE FRESNEL ACOUSTIC LENSES AND THEIR APPLICATION TO ACOUSTIC INK PRINTING

[75] Inventors: Calvin F. Quate, Stanford; Eric G. Rawson, Saratoga; Babur B. Hadimioglu, Palo Alto, all of Calif.

[73] Assignee: Xerox Corporation, Stamford, Conn.

[21] Appl. No.: 456,409

[22] Filed: Dec. 26, 1989

[51] Int. Cl.[5] ..... B41J 2/04

[52] U.S. Cl. ..... 346/140 R; 310/335

[58] Field of Search ..... 346/140 R; 310/335

[56] References Cited

U.S. PATENT DOCUMENTS

| | | | |
|---|---|---|---|
| 4,308,547 | 12/1981 | Lovelady et al. | 346/140 |
| 4,697,195 | 9/1987 | Quate et al. | 346/140 |
| 4,751,529 | 6/1988 | Elrod et al. | 346/140 |

OTHER PUBLICATIONS

G. J. Swanson et al., "Infrared Applications of Diffractive Optical Elements", *Holographic Optics: Design and Applications*, SPIE, vol. 883, 1988, pp. 155–162.

*Primary Examiner*—Bruce A. Reynolds
*Assistant Examiner*—Alrick Bobb

[57] ABSTRACT

Acoustic radiators which are focused diffractively by multi-discrete-phase binary Fresnel lenses are provided for applications, such as acoustic ink printing. Standard semiconductor integrated circuit techniques are available for fabricating such lenses in compliance with design specifications having relatively tight tolerances, including specifications for integrated lens arrays demanding substantial precision in the relative spatial positioning of several lenses. The diffractive performance of these lenses simulate concave refractive lenses, even though the lenses preferably have generally flat geometries. To that end, the lenses advantageously are defined by patterning acoustically flat surfaces, such as an acoustically flat face of a substrate or, better yet, an acoustically flat face of a layer of etchable material which is grown or otherwise deposited on an acoustically flat surface of an etch resistant substrate.

18 Claims, 3 Drawing Sheets

MULTI-DISCRETE-PHASE FRESNEL ACOUSTIC LENSES AND THEIR APPLICATION TO ACOUSTIC INK PRINTING

FIELD OF THE INVENTION

This invention relates to acoustic focusing lenses and, more particularly, to multi-discrete-phase Fresnel acoustic focusing lenses for acoustic ink printing.

CROSS-REFERENCE TO RELATED APPLICATION

A concurrently filed, commonly assigned United States patent application of Babur Hadimioglu et al. on an "Improved Process for Fabricating Multi-Discrete-Phase Fresnel Lenses" application Ser. No. 07/456,908, filed Dec. 26, 1989, pertains to a method which is well suited for manufacturing the acoustic lenses called for by this invention.

BACKGROUND OF THE INVENTION

Acoustic ink printers of the type to which this invention is addressed typically comprise one or more rf acoustic radiators for illuminating the free surface of a pool of liquid ink with respective acoustic beams. Each of these beams usually is brought to focus essentially on the free ink surface at a near normal angle of incidence. Furthermore, printing conventionally is performed by independently modulating the rf excitation of the acoustic radiators in accordance with the input data samples for the image that is to be printed. This modulation enables the radiation pressure which each of the beams exerts against the free ink surface to make brief, controlled excursions to a sufficiently high pressure level for overcoming the restraining force of surface tension. That, in turn, causes individual droplets of ink to be ejected from the free ink surface on demand at an adequate velocity to cause them to deposit in an image configuration on a nearby recording medium. Acoustic ink printing is attractive because it does not rely upon nozzles or small ejection orifices, which means that it alleviates some of the mechanical constraints that have caused many of the reliability and picture element ("pixel") placement accuracy problems conventional drop on demand and continuous stream ink jet printers have experienced.

Several different acoustic radiators (sometimes also referred to as "droplet ejectors") have been developed for acoustic ink printing. More particularly, there already are acoustically illuminated spherical acoustic focusing lenses (as described in a commonly assigned United States patent of Elrod et al., which issued June 14, 1989 as U.S. Pat. No. 4,751,529 on "Microlenses for Acoustic Printing"); piezoelectric shell transducers (as described in a United States patent of Lovelady et al., which issued Dec. 24, 1981 as U.S. Pat. No. 4,308,547 on "Liquid Drop Emitter"); and planar piezoelectric transducers with interdigitated electrodes (as described in a commonly assigned United States patent of Quate et al., which issued Sept. 29, 1987 as U.S. Pat. No. 4,697,105 on "Nozzleless Liquid Droplet Ejectors"). This existing droplet ejector technology is believed to be adequate for designing various printhead configurations, ranging from relatively simple, single ejector embodiments for raster output scanners (ROS's) to more complex embodiments, such as one or two dimensional, full page width arrays of droplet ejectors for line printing.

There still, however, is a need for sharply focused acoustic radiators which are easier and less expensive to manufacture in compliance with relatively exacting design specifications for applications, such as acoustic ink printing, requiring substantial predictability. There also is a need for less costly arrays of precisely positioned acoustic radiators. Moreover, the performance and reliability of some acoustic ink printers would be enhanced if the output faces of their acoustic radiators had more uniform ink flow characteristics, while other acoustic ink printers would benefit if the output faces of their acoustic radiators were easier to planarize.

SUMMARY OF THE INVENTION

In response to the foregoing and other needs, this invention provides acoustic radiators which are focused diffractively by multi-discrete-phase binary Fresnel lenses. Standard semiconductor integrated circuit techniques are available for fabricating these lenses in compliance with design specifications having relatively tight tolerances, including specifications for integrated lens arrays demanding substantial precision in the relative spatial positioning of several lenses. The diffractive performance of these lenses simulate concave refractive lenses, even though the lenses provided by this invention preferably have generally flat geometries. To that end, in keeping with some of the more detailed features of this invention, the lenses advantageously are defined by patterning acoustically flat surfaces, such as an acoustically flat face of a substrate or, better yet, an acoustically flat face of a layer of etchable material which is grown or otherwise deposited on an acoustically flat surface of an etch resistant substrate.

BRIEF DESCRIPTION OF THE DRAWINGS

Additional features and advantages of this invention will become apparent when the following detailed description is read in conjunction with the attached drawings, in which.

DETAILED DESCRIPTION OF THE ILLUSTRATED EMBODIMENTS

While the invention is described in some detail hereinbelow with specific reference to certain illustrated embodiments, it is to be understood that there is no intent to limit it to those embodiments. On the contrary, the aim is to cover all modifications, alternatives and equivalents falling within the spirit and scope of the invention as defined by the appended claims.

Figure 1:
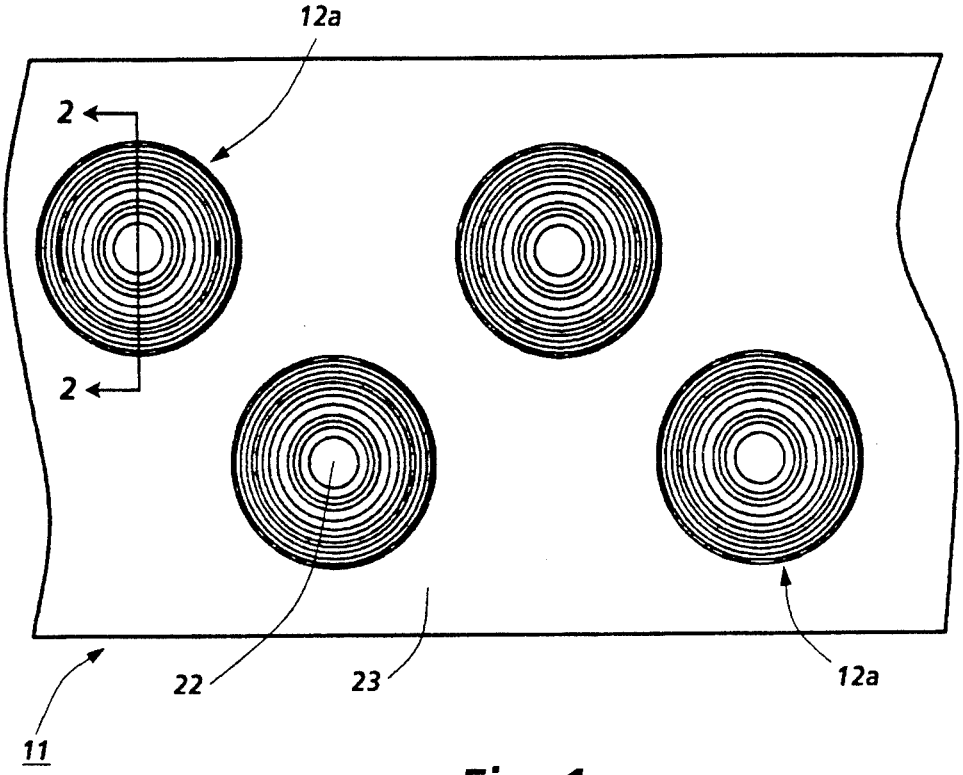
FIG. 1 is a simplified, fragmentary plan view of an acoustic ink printhead embodiment of the present invention which has a two dimensional array of four-phase Fresnel acoustic focusing lenses.

Turning now to the drawings, and at this point especially to FIG. 1, there is an acoustic ink printhead 11 comprising a two dimensional, pagewidth array (shown only in part) of substantially identical, spatially interlaced, multi-discrete-phase binary Fresnel acoustic focusing lenses 12*a*–12*i*. This particular printhead configuration is well suited for certain types of printing, such as line printing, but it will be evident that the present invention is applicable to other printhead configurations for implementing a variety of different print modes, including raster output scanning and dot matrix printing.

Multi-discrete-phase Fresnel elements have been proposed for optical applications. See Swanson et al., "Infrared Applications of Diffractive Optical Elements," *Holographic Optics: Design and Applications,* SPIE Vol. 883, 1988, pp 155–162. Thus, it is important to understand that their application to acoustics involves several unique considerations, including the magnitude and the sense of the velocity shift the incident radiation experiences as it propagates from such a lens into object space. Specifically, the wavefront velocity usually increases by roughly 33% in the optical case as the radiation passes from, say, glass into air. In contrast, in the acoustical case, the velocity of the wavefront typically drops by about 70%–84% as it radiates from glass or silicon, respectively, into, say, water-based ink. Therefore, multi-discrete-phase Fresnel lenses which simulate plano-concave refractive lenses are called for to achieve positive focusing in the acoustic case with lenses which are illuminated by plane waves.

Figure 2:
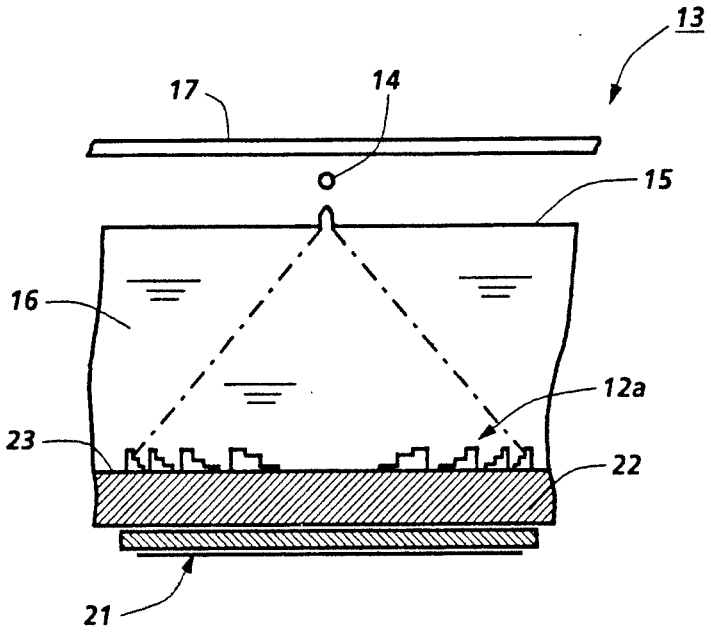
FIG. 2 is an enlarged, simplified sectional view, taken along the line 2—2 in FIG. 1 looking in the direction of the arrows, to illustrate one of the Fresnel lenses of the printhead shown in FIG. 1 as embodied in an acoustic ink printer.

As shown in FIG. 2, the printhead 11 is embodied in an acoustic ink printer 13 for ejecting individual droplets of ink 14 from the free surface 15 of a pool of liquid ink 16 on demand at a sufficient ejection velocity to cause the droplets 14 to deposit in an image configuration on a nearby recording medium 17. To that end, the printhead 11 comprises a planar piezoelectric transducer 21, such as a thin film ZnO transducer, which is deposited on or otherwise intimately bonded to the rear face of a suitable acoustically conductive substrate 22, such as an acoustically flat quartz, glass or silicon substrate. The opposite or front face of the substrate 22 (or, preferably, of an acoustically flat layer of material 23 which is grown or otherwise deposited on its front face), in turn, is patterned to define the concentric phase profiles of the Fresnel lenses 12*a*–12*i* (only the lens 12*a* can be seen in FIG. 2, but it is generally representative of the others). Specifically, as shown, the lenses 12*a*–12*i* are formed by patterning a layer 23 of etchable material, such as α-Si, which is grown on the front face of an etch resistant substrate 22, such as quartz or glass. As more fully described hereinbelow, an advantage of this approach is that it gives the designer additional freedom to form the substrate 22 from materials which are not easily etched, such as glass, quartz, etc., whereby the substrate 22 then functions as a relatively positive etch-top during the fabrication of the lenses 12*a*–12*i*.

Figure 5:
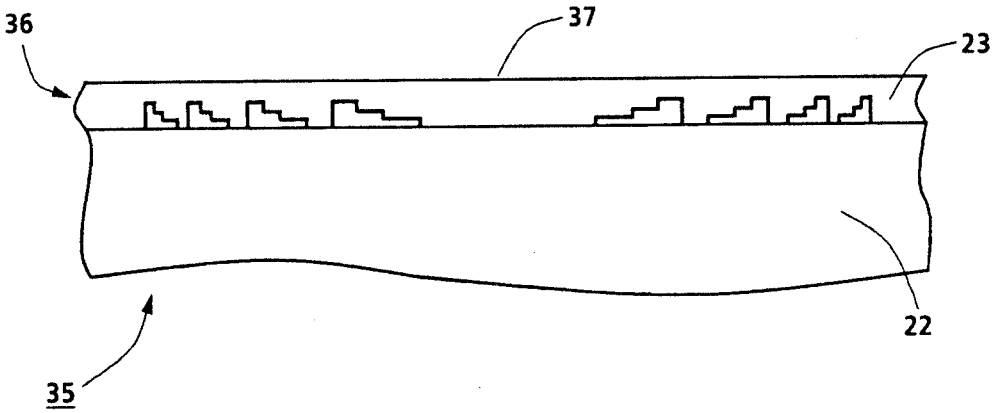
FIG. 5 illustrates a planarized embodiment of the lens shown in FIG. 2.

In operation, rf drive voltages are applied across the piezoelectric transducer 21 (by means not shown) on spatially separated centers which are acoustically aligned with the lenses 12*a*–12*i*, respectively. That locally excites the transducer 21 into oscillation about each of those centers, thereby causing it to generate longitudinally propagating acoustic plane waves within the substrate 22 for substantially independently, axially illuminating the lenses 12*a*–12*i*, respectively, at near normal angles of incidence. Alternatively, of course, separate piezoelectric transducers (not shown) could be utilized for illuminating the lenses 12*a*–12*i*. The lenses 12*a*–12*i* are acoustically coupled to the ink 16, either directly (as shown in FIG. 2 for the lens 12*a*) or through an intermediate monolayer or multilayer acoustic coupling medium (see FIG. 5). Furthermore, their focal length is selected to cause them to bring a significant percentage of the acoustic energy that is incident upon them to focus by diffraction essentially on the free surface 15 of the ink 16 as more fully described hereinbelow.

For reducing the sensitivity of the printer 13 to half-wave resonances, the rf frequency at which the transducer 21 is excited advantageously is more or less randomly shifted (by means not shown) about a predetermined center frequency in accordance with a noise or psuedo-random frequency modulating signal. The fractional bandwidth, $\Delta f/f$, of this frequency modulated rf suitably is on the order of 20%, where $\Delta f$ is the range over which the rf frequency is shifted. See a copending and commonly assigned United States patent application of Elrod et al., which was filed Dec. 21, 1988 under Ser. No. 07/287,791 on "Acoustic Ink Printers Having Reduced Focusing Sensitivity". It will become evident that some of the dimensions of the lenses 12*a*–12*i* are frequency dependent, so it is convenient to express them in "radians" so as to normalize them to the wavelength of the acoustic radiation in the medium by which the lenses 12*a*–12*i* are defined at the frequency (or, for the frequency modulated case, at the center frequency, f) of the incident radiation.

Each of the lenses 12*a*–12*i* addresses certain spatially unique pixel positions in the output image plane in a predetermined sequential order. Thus, for printing images, each of the lenses 12*a*–12*i* has a corresponding modulator, such as the modulator 25*a* for the lens 12*a*in FIG. 2. These modulators usually serially pulse modulate the rf excitation of the transducer 21, on a lens-by-lens basis, in accordance with the input data samples representing the image pixels for one after another of the pixel positions the lenses 12*a*–12*i*, respectively, address. As a general rule, the data rate at which this modulation is carried out is timed synchronized (by means not shown) with the relative motion of the lenses 12*a*–12*i* from pixel position-to-pixel position which, in turn, is selected to ensure that there is a sufficient time interval between the addressing of successive pixel positions for the free ink surface 15 of the ink 16 to "relax" (i.e., return to a substantially stable state). If desired, a perforated membrane or the like (not shown) may be employed to assist in maintaining the free surface 15 of the ink 16 at a predetermined level. See a copending and commonly assigned U.S. patent application of Khuri-Yakub et al., which was filed May 30, 1989 under Ser. No. 07/358,752 on "Perforated Membranes for Liquid Control in Acoustic Ink Printing".

The lens-by-lens modulation of the drive voltages applied to the transducer 21 more or less independently modulates the acoustic illumination of the lenses 12*a*–12*i*, respectively. Accordingly, the radiation pressures which the diffractively focused acoustic energy (i.e., the +1 diffraction order) that radiates from the lenses 12*a*–12*i*, respectively, exert against the free ink surface 15 are correspondingly modulated. Sufficient acoustic energy is supplied to enable the radiation pressure of each of those beams to make brief, controlled excursions to a sufficiently high pressure level for ejecting individual droplets of ink 17 from the free ink surface 15 in response to data samples representing, for example, the black pixels of a black and white image.

Figure 3:
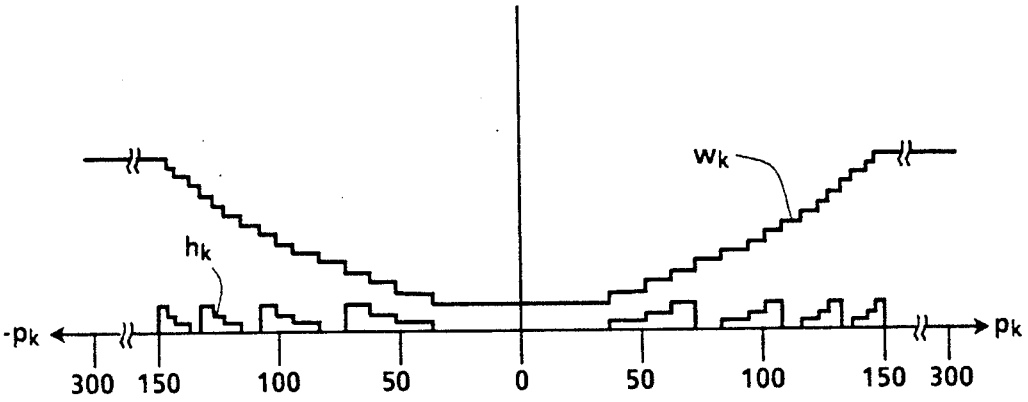
FIG. 3 illustrates the radial profile of the lens shown in FIG. 2 and the approximately spherical wavefront it imparts to the acoustic energy it diffracts into the +1 diffraction order when it is illuminated at a near normal angle of incidence by an axially propagating acoustic plane wave.

Turning next to FIG. 3 for a more detailed discussion of the multi-discrete-phase Fresnel acoustic focusing lenses that are provided by this invention, it will be seen that the phase profile of the representative lens 12*a* is a quantized approximation of the continuous phase profile of a theoretically ideal, 100% efficient, Fresnel zone plate. Accordingly, it will be evident that the acoustic focusing efficiency of the lens 12*a* and the width of its narrowest feature (i.e., its outermost phase step) are dependent upon the number, n, of discrete phase levels to which its phase profile is quantized. More specifically, as described in the above-identified Swanson et al article, two phase, four phase, eight phase and sixteen phase embodiments are approximately 41%, 81%, 95%, and 99% efficient, respectively, for diffracting axial incident radiation into a focused +1 diffraction order. The remainder of the incident energy is diffracted into the higher positive diffraction orders and into the negative diffraction orders, but virtually none of it is diffracted into the zeroth order. This suggests that the two phase embodiment might be somewhat marginal for at least some acoustic ink printing applications, such as when the printing is performed using an array of lenses (a case in which the two phase embodiment might require relatively extraordinary provision for preventing undesirable levels of crosstalk between spatially adjacent lenses). The four, eight and sixteen phase embodiments progressively reduce the amount of energy that is diffracted into the unwanted, potentially troublesome orders by a cumulative factor of approximately 3× each, so they are preferred from an acoustics point of view.

The lens 12*a* shown in FIG. 3 has four discrete phase levels because a four phase embodiment can be manufactured readily through the use of currently available semiconductor integrated circuit fabrication techniques. This particular lens is formed by patterning an α-Si layer 23 having a longitudinal sound velocity of approximately 8603 m/sec. to bring axially incident, plane wave acoustic radiation having a nominal frequency of 167 MHz to focus in a +1 diffraction order at a focal distance of 300 μm through an intermediate liquid layer having a longitudinal sound velocity of 1500 m/sec. Moreover, the lens 12*a* is designed to have f/number of f/1. In view of those design parameters, the radial phase profile of the lens 12*a* and the approximate relative phase advance, $w_k$, associated with each of its phase steps are as set forth below (all dimensions are expressed in microns):

| $k_k$ | $\rho_k$ | $h_k$ | $w_k$ |
|---|---|---|---|
| 0 | 0 | 0 | 8.982 |
| 1 | 36.774 | 2.72 | 11.228 |
| 2 | 52.104 | 5.439 | 13.473 |
| 3 | 63.932 | 8.159 | 15.719 |
| 4 | 73.959 | 0 | 17.964 |
| 5 | 82.841 | 2.72 | 20.21 |
| 6 | 90.914 | 5.439 | 22.455 |
| 7 | 98.378 | 8.159 | 24.701 |
| 8 | 105.362 | 0 | 26.946 |
| 9 | 111.956 | 2.72 | 29.192 |
| 10 | 118.226 | 5.439 | 31.437 |
| 11 | 124.219 | 8.159 | 33.683 |
| 12 | 129.976 | 0 | 35.928 |
| 13 | 135.525 | 2.72 | 38.174 |

-continued

| $k_k$ | $\rho_k$ | $h_k$ | $w_k$ |
|---|---|---|---|
| 14 | 140.892 | 5.439 | 40.419 |
| 15 | 146.096 | 8.159 | 42.665 |
| 16 | 151.155 | 0 | 44.91 |

where $k_k$ is a dimensionless phase step index; $\rho_k$ is the radial distance from the center of the aperture of the lens 12*a* to its $k^{th}$ phase transition; and $h_k$ is the height of the $k^{th}$ phase step of the lens 12*a* relative to the surface of the underlying substrate 22 (FIG. 2). As will be seen, there are sixteen $\pi/2$ radian phase transitions (index numbers 0–16) within the aperture of the lens 12*a*, which are spatially sequenced to define four complete $2\pi$ radian phase cycles. The relative phase change of the +1 diffraction order that is caused by these phase transitions is expressed as a relative "phase advance," $w_k$, because the acoustic velocity of the wavefront of the radiation decreases as it propagates from the lens 12*a* into the ink 16 (FIG. 2). For that reason, the lens 12*a* is designed so that its "phase delay" for the +1 diffraction order decreases radially of its aperture as a function of approximately the square of the radial distance, $\rho_k$, which means that the lens 12*a* simulates a concave refractive lens.

Advantageously, the lenses 12*a*–12*i* are fabricated through the use of a conventional photolithographic patterning process for etching them into an acoustically flat layer 23 of etchable material, such as a-Si, which is grown or otherwise deposited on an acoustically flat face of an etch resistant substrate 22, such as a quartz or glass substrate. It, therefore, is worth noting that the narrowest feature of the representative four phase lens 12*a* is about 5 μm wide (see index No. 15 of the foregoing table), which clearly is well within the resolution limits of standard large area microelectronic photolithographic patterning processes. Indeed, it can be shown that the narrowest feature of a corresponding eight phase lens has a width of approximately 2.5 μm, which also is consistent with the capabilities of modern photolithography.

If the thickness of the α-Si layer 23 can be controlled with sufficient precision while it is being deposited to yield an acoustically flat layer of a-Si having a thickness essentially equal to the height of the highest phase steps of the lenses 12*a*–12*i* (i.e., a thickness of $2\pi(n-1)/n$ radians), no further pre-etch processing is required. It sometimes may be easier, however, to first grow a somewhat thicker layer of a-Si on the substrate 22 and to thereafter polish that a-Si layer down to the thickness and acoustical flatness desired of the layer 23.

Figure 4:
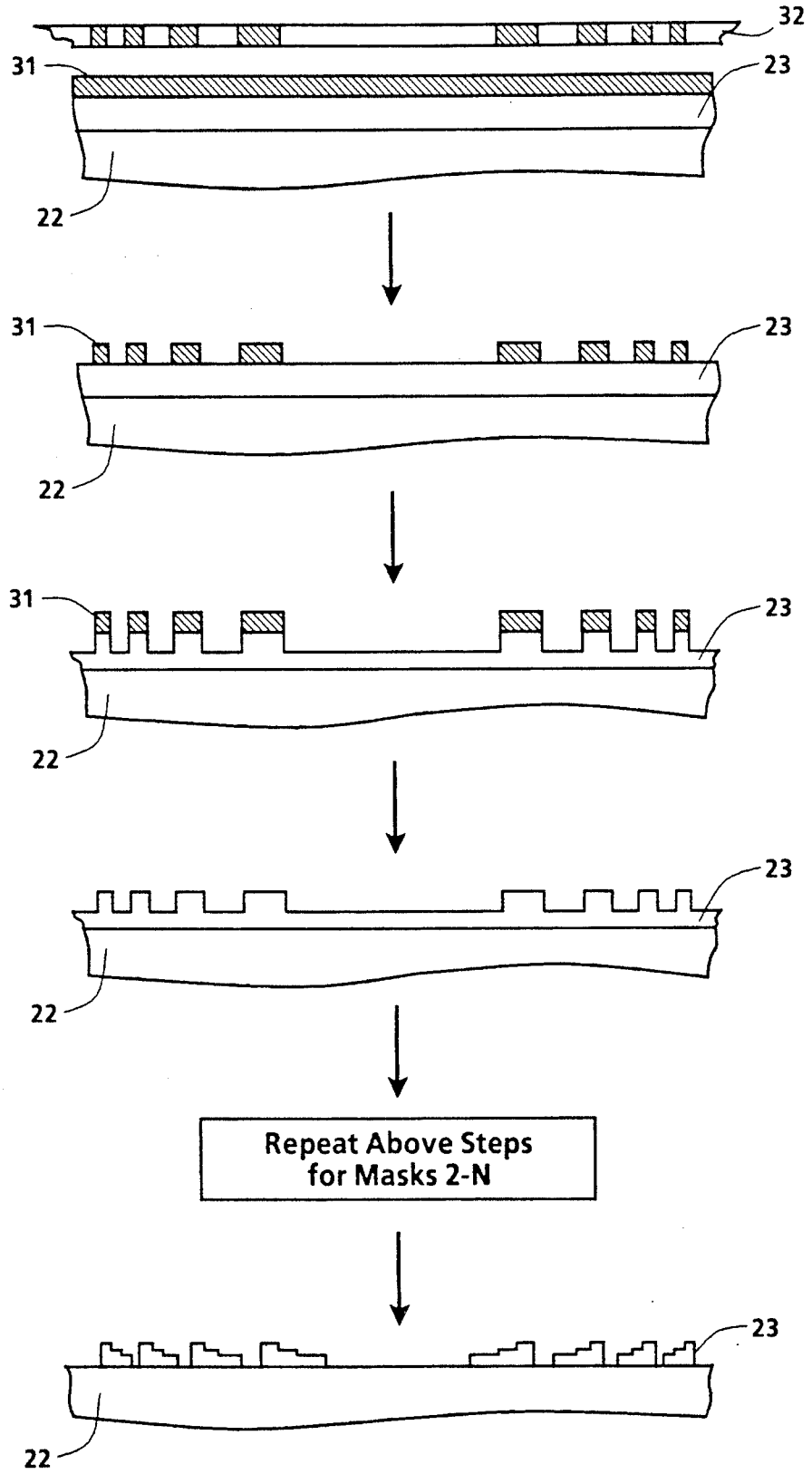
FIG. 4 illustrates a preferred process for fabricating multi-discrete-phase Fresnel lenses.

Referring now to FIG. 4, it will be seen that one or more photolithographic etch steps are employed for etching the phase profiles of the lenses 12*a*–12*i* into the a-Si layer 23. As few as N binary weighted amplitude masks are sufficient for defining th phase profiles for Fresnel lenses 12*a*–12*i* having n discrete phase levels, where n=a modulo-2 integer and 2N=n. The individual masks of a multi-mask mask set may be etched into the a-Si layer 23 in any desired order, but the depth to which the masks of a binary weighted mask set are etched into the a-Si layer 23 varies from mask-to-mask in dependence upon their respective binary weights. Specifically, if a counting number index value, i, is employed for sequentially numbering the masks of a binary weighted mask set in order from the most heavily weighted to the least heavily weighted mask, the etch depth, $d_i$, for mask number i is given by:

$$d_i = 2^{i-1} \cdot \pi \text{ radians}$$

where $i = 1, 2, \ldots, N$.

Of course, whenever a plurality of masks are employed, a mask aligner (not shown) should be used to register the successive mask patterns with the appropriate precision.

For imparting the desired phase profile to the lenses 12a–12i through the use of standard photolithography, the α-Si layer 23 is overcoated with a conventional uv-sensitive photoresist 31 which then is exposed to uv radiation in accordance with the binary amplitude pattern of a first mask 32. Thereafter, the exposed photoresist 31 typically is removed from the α-Si layer 23, such as by a wet etch washing. An anisotropic etch, such as a reactive ion etch, then is employed for removing material from the exposed regions of the α-Si layer 23 (i.e., the regions not overcoated with the unexposed photoresist 31) to a depth dependent upon the binary weight of the mask 32. An anisotropic etch is preferred because it creates phase steps having essentially vertical sidewalls, thereby producing sharp phase transitions between neighboring phase steps.

After the pattern of the first mask 32 has been etch into the α- Si layer 23, the residual photoresist 31 is removed. The foregoing process then can be repeated as often as is required for etching one after another of any additional mask patterns into the α-Si layer 23. As previously pointed out, the etch depth for a multi-mask set of binary weighted amplitude masks varies from mask-to-mask. However, the cumulative depth of all of the etches is:

$$\sum_{i=1}^{N} 2\pi/2\exp \cdot i = 2\pi(n-1)/n \text{ radians}$$

so the etch resistant substrate 22 is an effective etch-stop for the final etch.

Advantageously, the focusing that is performed by the lenses 12a–12i is entirely diffractive. Thus, the lenses 12a–12i are shown as having generally flat geometries which are modulated by their phase profiles. Flat lens geometries are preferred for acoustic ink printers, such as the printer 13 (FIG. 3), in which the lenses 12a–12i are directly coupled to the ink 16 because it is relatively easy to maintain a smooth, uniform flow of ink across the output or radiating face of such a lens. Moreover, flat lens geometries also are preferred for acoustic ink printheads, such as the printhead 35 of FIG. 5, which are planarized by overcoating them with a thin, acoustically conductive, plararizing layer 37 composed, for example, of a polymer, such as polyimide or PMMA. The relatively flat geometry of the lens or lenses 36 makes it relatively easy to spin-coat or otherwise overcoat the printhead 35 with an essentially planar layer 37 of the selected acoustic coupling medium.

As will be appreciated, whenever an intermediate acoustic coupling medium, such as the planarizing layer 37, is provided for acoustically coupling the lens or lenses 36 to the ink 16 (FIG. 2), its longitudinal acoustic velocity should be taken into account while computing the lens phase profiles. For example, if the lens or lenses 36 are designed based on the same design parameters as set forth hereinabove with reference to the design of the lens 12a, in view of the additional assumption that they will be overcoated with a thin layer of polyimide (longitudinal acoustic velocity of 2300 m/sec.), each of the phase step heights given in the foregoing table should be increased by a factor of approximately 1.127, The corresponding factor for the PMMA planarized embodiment of the printhead 35 (assuming all other design parameters are the same) is about 1.203.

CONCLUSION

In view of the foregoing, it now will be apparent that the multi-discrete-phase Fresnel acoustic focusing lenses of this invention are well suited for acoustic ink printing and for other applications requiring economical acoustic focusing lenses complying with relatively exacting specifications, including specifications governing the relative spatial positioning of such lenses in integrated lens arrays. Furthermore, it will be understood that the relatively flat geometries of the acoustic focusing lenses provided by the preferred embodiments of this invention are advantageous for acoustic ink printers of various types, including those in which the lenses are acoustically coupled to the ink directly and those in which the lenses are indirectly acoustically coupled to the ink through an intermediate acoustic coupling medium, such as a printhead planarizing layer.

What is claimed:

1. An acoustic radiator for radiating an object plane to which it is acoustically coupled with focused acoustic energy; said radiator comprising a multi-discrete-phase Fresnel lens supported at a predetermined focal distance from said object plane, and means acoustically coupled to said lens for illuminating it with acoustic energy;

said lens having a radial phase profile selected to diffract a substantial portion of said acoustic energy into a predetermined diffraction order at diffraction angles which vary radially of said lens, said diffraction angles being selected to cause the acoustic energy within said diffraction order to come to focus essentially on said object plane.

2. The acoustic radiator of claim 1 wherein said lens is composed of a material having a predetermined longitudinal acoustic velocity and is acoustically coupled to said object plane by a medium having a lower longitudinal acoustic velocity, and the radial phase profile of said lens is selected for diffracting acoustic energy into said diffraction order with a relative phase delay which decreases radially of said lens approximately as a function of the square of the radius.

3. The acoustic radiator of claim 2 wherein said lens has a generally flat geometry which is modulated in accordance with said radial phase profile, said lens is axially illuminated at a near normal angle of incidence by acoustic waves having generally planar wavefronts, and said predetermined diffraction order is a +1 order.

4. The acoustic radiator of any of claims 1–3 wherein said lens comprises an acoustically conductive member having a face which is patterned to define the radial phase profile of said lens.

5. The acoustic radiator of any of claims 1–3 wherein said lens comprises an acoustically conductive substrate, and a layer of etchable material which is deposited on said substrate, and said layer of etchable material is patterned to define the radial phase profile of said lens.

6. The acoustic radiator of claim 5 wherein said etchable material is patterned to have a maximum nominal acoustic thickness of approximately $2\pi(n-1)/n$ radians, where n is the number of discrete phase levels of said lens, and said substrate is composed of an etch-resistant material.

7. The acoustic radiator of claim 6 wherein said etchable material is amorphous silicon.

8. The acoustic radiator of claim 2 wherein said lens comprises an acoustically flat, acoustically conductive, etch-resistant substrate, and a $2\pi(n-1)/n$ radian thick layer of material which is deposited on said substrate, said layer of material being patterned to define the radial phase profile of said lens.

9. An integrated array of acoustic radiators for radiating an object plane to which said radiators are acoustically coupled with a plurality of focused acoustic beams, said array comprising an acoustically conductive substrate, a plurality of substantially identical, multi-discrete-phase Fresnel focusing lenses supported on said substrate, on predetermined centers, at a predetermined focal distance from said object plane, and means coupled to said substrate in acoustic alignment with said lenses for acoustically illuminating them, whereby each of said lenses diffracts incident acoustic energy into a predetermined diffraction order which it brings to focus essentially on said object plane.

10. The array of claim 9 further including a layer of material deposited on said substrate, said layer being patterned to define said lenses.

11. The array of claim 10 wherein said layer of material is composed of amorphous silicon.

12. An improved printhead for ejecting individual droplets of ink from a free surface of a pool of liquid ink on demand for printing images on a nearby recording medium; said printhead comprising an acoustically conductive substrate, at least one multi-discrete-phase Fresnel focusing lens supported on said substrate in acoustic communication with said ink, and means acoustically coupled to said substrate illuminating said lens with rf acoustic energy, said means including means for modulating said rf energy;

said at least one lens having a phase profile selected to diffract a substantial portion of said acoustic energy into a predetermined diffraction order at diffraction angles which vary radially of said lens, whereby said lens brings the energy it diffracts into said diffraction order to focus essentially on said free ink surface for exerting a radiation pressure against said free ink surface, with said radiation pressure being modulated in accordance with the modulation of said rf energy to eject individual droplets of ink from said free ink surface on demand at an ejection velocity sufficient to cause said droplets to deposit in an image configuration on said recording medium.

13. The printhead of claim 12 wherein said substrate has an acoustically flat face for supporting said lens;

a layer of material is deposited on said face of said substrate, with said layer of material being patterned to define the phase profile of said lens; and said means for illuminating said lens illuminates it with essentially plane wave rf acoustic energy at a near normal angle of incidence.

14. The printhead of claim 13 wherein said predetermined diffraction order is a +1 order.

15. The printhead of claim 14 wherein said layer of material has a maximum nominal acoustic thickness of approximately $2\pi(n-1)/n$ radians, where said lens has n discrete phase levels;

the phase profile of said lens is etched into said layer of material; and said substrate is composed of an etch resistant material.

16. The printhead of any of claim 11–15 wherein said ink has a predetermined longitudinal acoustic velocity, said lens is composed of a material having a longitudinal acoustic velocity which is greater than the longitudinal acoustic velocity of said ink, and said lens has a phase profile which is selected to diffract acoustic energy into said diffraction order with a phase delay which decreases radially of the lens.

17. The printhead of any of claim 11–15 wherein said printhead has an plurality of substantially identical lenses which are supported by said substrate on spaced apart centers, and said illuminating means substantially independently illuminates each of said lenses with modulated rf energy for controlling the ejection of said droplets of ink on a lens-by-lens basis.

18. The printhead of claim 17 wherein said ink has a predetermined longitudinal acoustic velocity, said lenses are composed of a material having a longitudinal acoustic velocity which is greater than the longitudinal acoustic velocity of said ink, and each of said lenses has a phase profile which is selected to diffract acoustic energy into said diffraction order with a phase delay which decreases radially of the lens.

* * * * *